US011005185B2

(12) United States Patent
Howarth et al.

(10) Patent No.: US 11,005,185 B2
(45) Date of Patent: May 11, 2021

(54) MILLIMETER WAVE CONFORMAL SLOT ANTENNA

(71) Applicant: BAE SYSTEMS Information and Electronic Systems Integration Inc., Nashua, NH (US)

(72) Inventors: Dean W. Howarth, Sudbury, MA (US); Jonothan S. Jensen, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/578,653

(22) Filed: Sep. 23, 2019

(65) Prior Publication Data

US 2021/0091461 A1 Mar. 25, 2021

(51) Int. Cl.
*H01Q 13/18* (2006.01)
*H01Q 1/38* (2006.01)

(52) U.S. Cl.
CPC ..... *H01Q 13/18* (2013.01); *H01Q 1/38* (2013.01)

(58) Field of Classification Search
CPC ..... H01Q 1/38; H01Q 9/0457; H01Q 13/109; H01Q 13/18
See application file for complete search history.

(56) References Cited

U.S. PATENT DOCUMENTS 3,553,607 A * 1/1971 Lehrfeld ..... H01R 24/52 333/34
4,074,270 A * 2/1978 Kaloi ..... H01Q 1/521 343/700 MS
4,157,548 A 6/1979 Kaloi
5,025,264 A * 6/1991 Stafford ..... H01Q 13/18 343/767
6,646,618 B2 * 11/2003 Sievenpiper ..... H01Q 13/10 343/713
8,814,601 B1 * 8/2014 Sherrer ..... H01R 24/50 439/625
9,391,372 B2 * 7/2016 Hwang ..... H01Q 13/106
2003/0011522 A1 * 1/2003 McKinzie, III ..... H01Q 15/008 343/700 MS
2011/0050509 A1 * 3/2011 Ayala Vazquez .... H01Q 1/2266 343/702

(Continued)

OTHER PUBLICATIONS

A. T. Alreshaid, O. Hammi, M. S. Sharawi and K. Sarabandi, "A compact millimeter-wave slot antenna array for 5G standards," 2015 IEEE 4th Asia-Pacific Conference on Antennas and Propagation (APCAP), Kuta, 2015, pp. 84-85, doi: 10.1109/APCAP.2015.7374281. (Year: 2015).*

(Continued)

*Primary Examiner* — Dimary S Lopez Cruz
*Assistant Examiner* — Yonchan J Kim
(74) *Attorney, Agent, or Firm* — KPIP Law, PLLC; Scott J. Asmus

(57) ABSTRACT

The system and method for a conformal millimeter wave (mmW) cavity backed slot antenna with near positive gain and hemispherical gain coverage. The antenna has a microstrip launch and feed and a surface mount connector. The mmW antenna may have a stripline launch or waveguide launch instead of a microstrip launch. In some cases, the microwave electronics can be mounted on the launch substrate instead of a connector.

10 Claims, 9 Drawing Sheets

(56) References Cited

U.S. PATENT DOCUMENTS

2017/0110787 A1* 4/2017 Ouyang ..... H01Q 1/40

OTHER PUBLICATIONS

Siddharth Dave, "Design and Prototype of a Phased-Array Antenna for Nanosatellite Radar and Communication Applications", Graduate program in Earth and Space Science Engineering, York University, Toronto, Ontario, Canada, (128 pages) Jul. 2018.

* cited by examiner

MILLIMETER WAVE CONFORMAL SLOT ANTENNA

FIELD OF THE DISCLOSURE

The present disclosure relates to conformal antennas in the millimeter wave (mmW) frequency range and more particularly to a conformal antenna in the mmW frequency range with near positive gain and hemispherical gain coverage.

BACKGROUND OF THE DISCLOSURE

Typically, antennas operating at millimeter wave (mmW) frequencies need to have components with tight tolerances of the parts and their placement relative to a wavelength in the 20-40 GHz range and this negatively impacts performance of the antenna if these requirements are not met. A slot antenna consists of a metal surface, usually a flat plate, with one or more holes or slots cut out. When the plate is driven as an antenna by a driving frequency, the slot radiates electromagnetic waves in a way similar to a dipole antenna. The shape and size of the slot, as well as the driving frequency, determine the radiation pattern. Often the radio waves are provided by a waveguide, and the antenna consists of slots in the waveguide. Slot antennas are often used at UHF and microwave frequencies instead of line antennas when greater control of the radiation pattern is required.

Wherefore it is an object of the present disclosure to overcome the above-mentioned shortcomings and drawbacks associated with the conventional slot antennas.

SUMMARY OF THE DISCLOSURE

One aspect of the present disclosure is a system comprising a conformal slot antenna, comprising: a conformal cavity backed mmW slot antenna with near positive gain and hemispherical gain coverage, having a 50 ohm feed that splits to 100 ohms, wherein the slot antenna geometry tapers down at a feed point.

One embodiment of the conformal slot antenna is wherein the geometry of the slot antenna resembles a barbell. In some cases, the slot antenna is a printed circuit board. In certain embodiments, the slot antenna comprises aluminum.

Another embodiment of the conformal slot antenna further comprises a radome. In some cases, the conformal slot antenna further comprises microstrip feedlines. In other cases, the conformal slot antenna further comprises stripline feedlines.

Yet another embodiment of the conformal slot antenna further comprises a connector.

Another aspect of the present disclosure is a conformal slot antenna, comprising: a conformal cavity backed mmW slot antenna with near positive gain and hemispherical gain coverage operating at 20-40 GHz, the slot antenna having a 50 ohm feed that splits to 100 ohms, wherein the slot antenna geometry tapers down at a feed point and resembles a barbell.

Yet another aspect of the present disclosure is a conformal slot antenna, comprising: a conformal cavity backed mmW slot antenna with near positive gain and hemispherical gain coverage operating at 20-40 GHz; a microstrip launch and feed; and a surface mounted connector; the slot antenna having a 50 ohm feed that splits to 100 ohms, wherein the slot antenna geometry tapers down at a feed point and resembles a barbell.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

There was a need for a conformal antenna with near positive gain and hemispherical gain coverage. Power consumption can be an issue for some systems, therefore if higher gain numbers can be achieved less power is required in the transmit assembly for those systems. In a transmitting antenna, the gain describes how well the antenna converts input power into radio waves headed in a specified direction. In a receiving antenna, the gain describes how well the antenna converts radio waves arriving from a specified direction into electrical power. When no direction is specified, "gain" is understood to refer to the peak value of the gain, the gain in the direction of the antenna's main lobe. A plot of the gain as a function of direction is called the gain pattern or radiation pattern. Having hemispherical gain coverage helps reduce the number of antennas and transmit assemblies required if coverage of a wide field of view is required. In one embodiment of the present disclosure, a slot antenna was frequency scaled and tuned to work at 20 GHz to 40 GHz. In certain embodiments, the mmW frequency range is used. In some cases, the conformal slot antenna of the present disclosure has the potential to be used as part of the 5G wireless industry.

Extremely high frequency (EHF) is the International Telecommunication Union (ITU) designation for the band of radio frequencies in the electromagnetic spectrum from 30 to 300 gigahertz (GHz). It lies between the super high frequency band, and the far infrared band, the lower part of which is also referred to as the terahertz gap. Radio waves in this band have wavelengths from ten to one millimeter, so it is also called the millimeter band and the radiation in this band is called millimeter waves, sometimes abbreviated MMW or mmW.

Figure 1A:
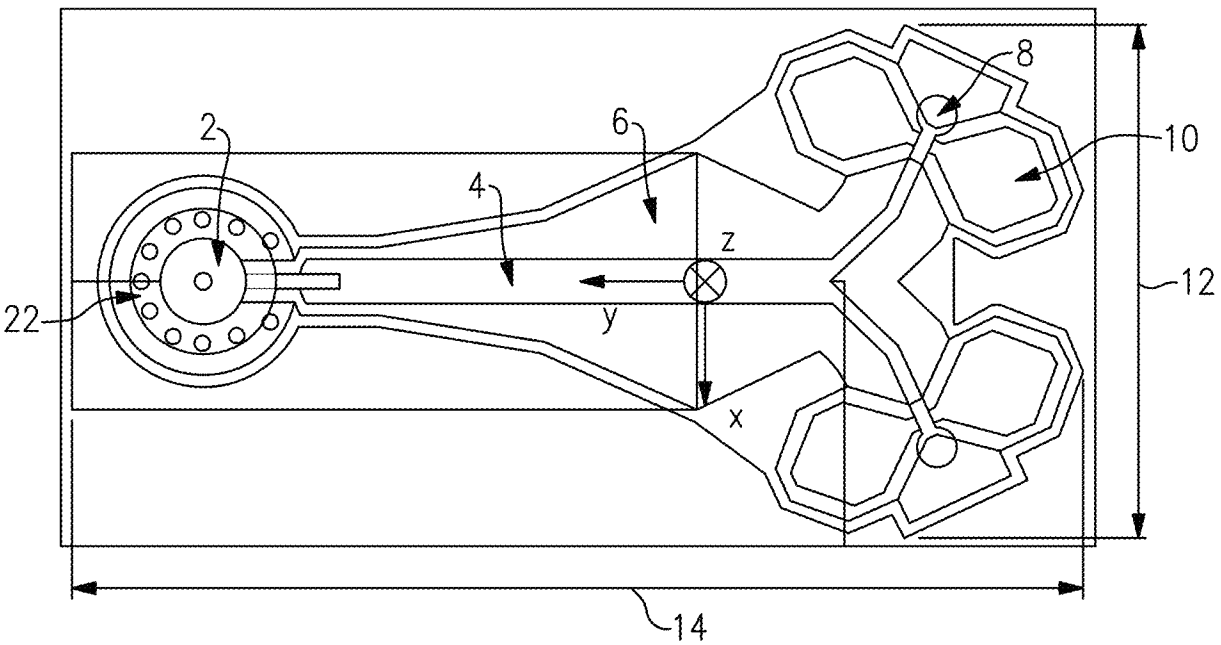
FIG. 1A shows a top view of one embodiment of a conformal slot antenna according to the principles of the present disclosure.

Referring to FIG. 1A, a top view of one embodiment of a conformal slot antenna according to the principles of the present disclosure is shown. More specifically, 4 is a microstrip 50 ohm line that splits into two 100 ohm lines, and 8 is where the feed via goes towards the slot. The slot 10 is cut out of the copper trace on the back side of the board. This shape looks similar to a barbell. This shape is unique because a standard straight slot has a narrow frequency bandwidth (~10%) where the antenna is well matched to 50 ohms. This shape allows for a good impedance match over a 2:1 bandwidth as well as maintains a required antenna pattern shape. The exposed circuit board 6 is visible after the copper is etched away. An overhead view of a surface launch GPO connector 2 is also shown. A model representation of a ring of grounding vias 22 is shown around the connector.

Figure 1B:
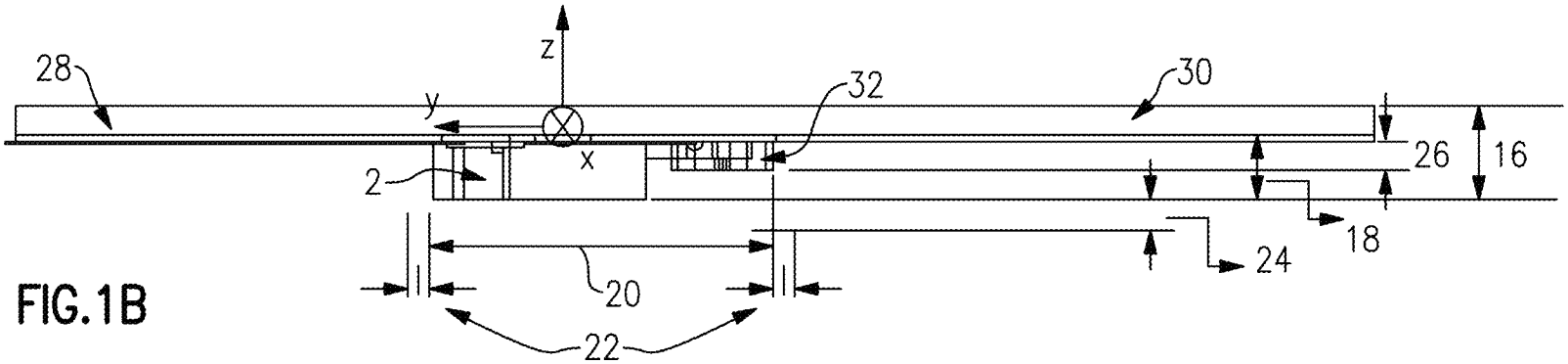
FIG. 1B shows a cross-sectional view of one embodiment of a conformal slot antenna according to the principles of the present disclosure.

Referring to FIG. 1B, a cross-sectional view of one embodiment of a conformal slot antenna according to the principles of the present disclosure is shown. More specifically, 30 is the aluminum plate the slot is cut out of, 28 is the PCB board and 32 is the air cavity that is required behind the slot antenna. In one embodiment, when manufactured the cavity would be cut out of metal like aluminum. An overall length 14 (shown as 20 in FIG. 1B) and width 12 are also shown as are several representative dimensions such as overall thickness 16 and various component thicknesses (e.g., 18, 24, 26).

In certain embodiments a sub-miniature push-on (SMP) connector was replaced with a GPO (or Gilbert Push-on) connector. In some embodiments, a connector is built into the board. In certain cases, a low noise amplifier or transmit amplifier is built into the board and connector is not needed. In some cases, a single GPO input connector was used. The design is not limited to GPO. GPPO, G3PO or G4PO can also be used with updates to the artwork.

Figure 2:
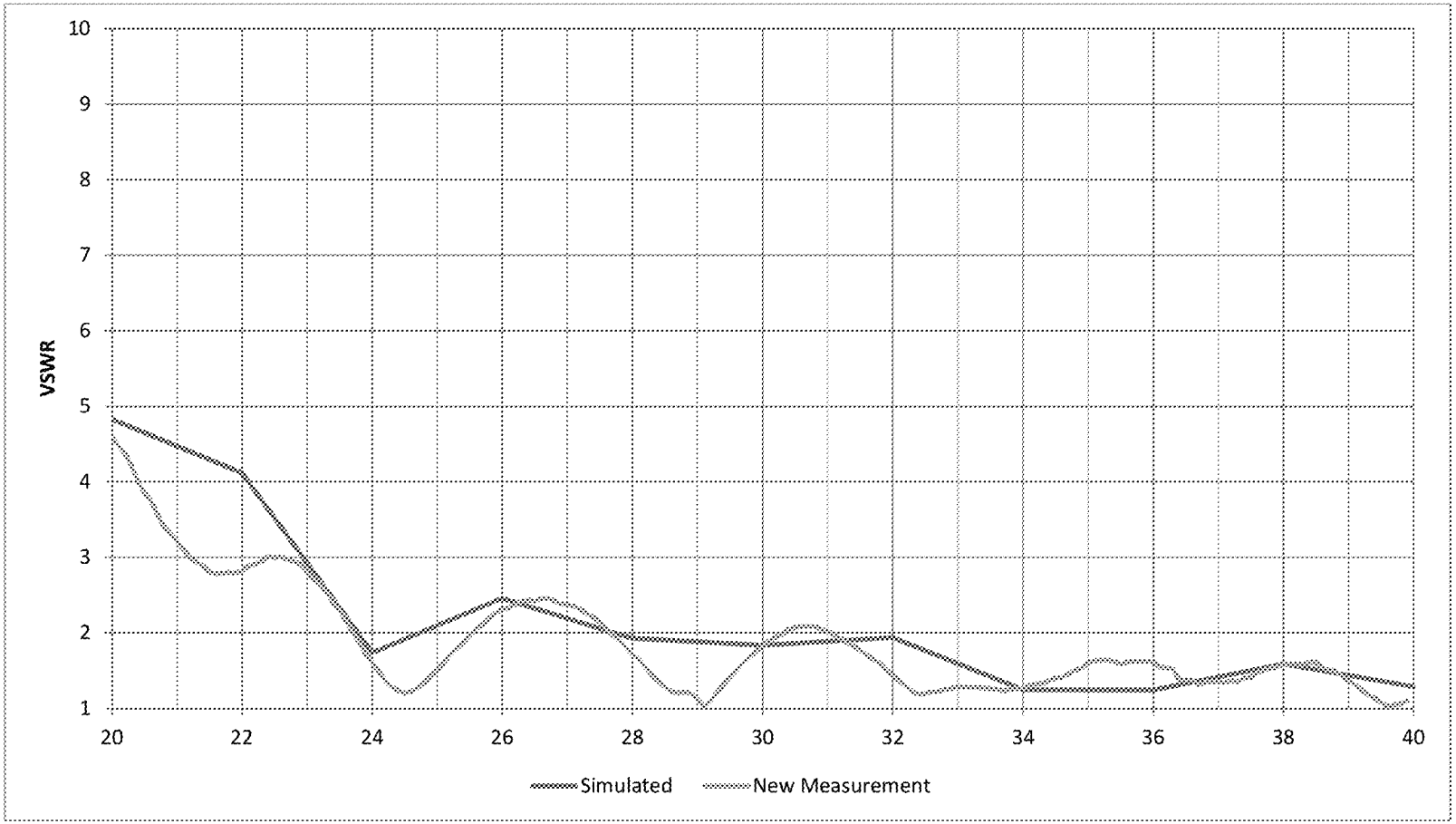
FIG. 2 shows a plot of Voltage Standing Wave Ratio (VSWR) for simulated versus measured data for one embodiment of a conformal slot antenna according to the principles of the present disclosure.

Referring to FIG. 2, a plot of Voltage Standing Wave Ratio (VSWR) for simulated versus measured data for one embodiment of a conformal slot antenna according to the principles of the present disclosure is shown. More specifically, the VSWR is plotted from 20 GHz to 40 GHz. Note that VSWR is a measure of how much power is delivered to an antenna. This does not mean that the antenna radiates all the power it receives. Hence, VSWR measures the potential to radiate. A low VSWR means the antenna is well-matched, but does not necessarily mean the power delivered is also radiated. An anechoic chamber or other radiated antenna test is required to determine the radiated power.

When testing an antenna, a number of parameters such as the radiation pattern, gain, impedance, or polarization characteristics are measured. One of the techniques used to measure antenna patterns is the far-field range where an antenna under test (AUT) is placed in the far-field of a transmit range antenna. A second technique is the near-field range where the AUT is placed in the near-field and then the data is mathematically transformed to the far-field. Depending on the antenna and the application, a near-field, or far-field range will be the preferred technique to properly determine the amplitude and/or phase characteristics of an AUT.

One embodiment of the conformal antenna of the present disclosure was tested by installing it on a 2 foot diameter ground plane. In that test, two range setups were used (18 GHz-26.5 GHz and 26.5 GHz-41.5 GHz). In one setup, a transmitting antenna, a PNA (Performance Network Analyzer) and the AUT were used with a directional coupler and amplifiers. The antenna was positioned on a mast that could rotate the antenna for both azimuth and elevation cuts. The range was calibrated using known standard gain horns and that calibration data was applied to these measurements to compute the final gain numbers.

Figure 3A:
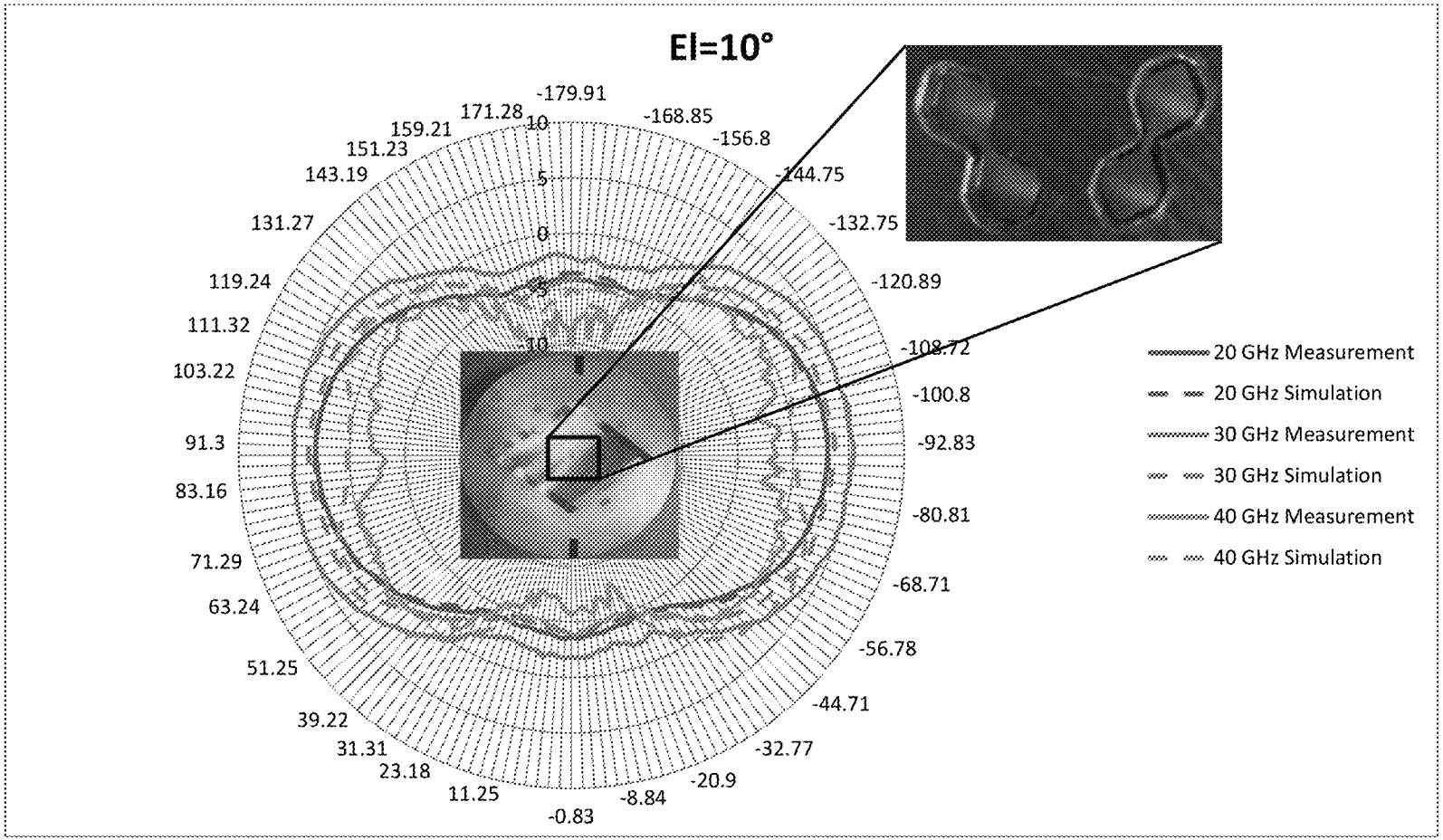
FIG. 3A is a plot of azimuth modeled versus measured singular polarization at 10° elevation for one embodiment of a conformal slot antenna according to the principles of the present disclosure.

Referring to FIG. 3A, a plot of azimuth modeled versus measured singular polarization at 10° elevation for one embodiment of a conformal slot antenna according to the principles of the present disclosure is shown. More specifically, 20 GHz, 30 GHz, and 40 GHz are plotted. These give representative antenna patterns over the whole frequency range. It can been seen that the measured data correlated well with the model data. At 40 GHz the delta between the model and measured data is most likely diffraction effects related to the ground plane.

Figure 3B:
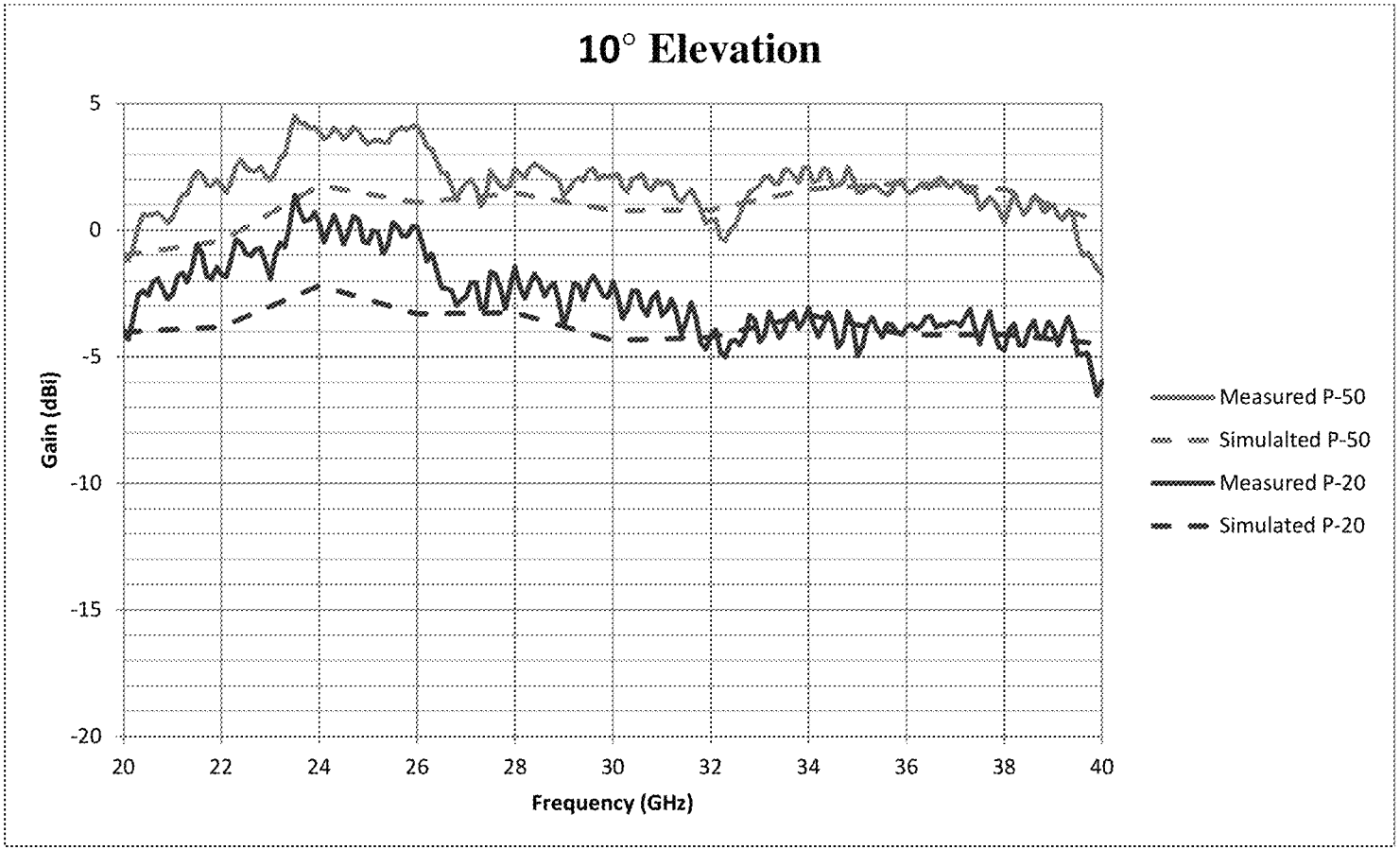
FIG. 3B is a plot of gain versus frequency for two embodiments of conformal slot antennas at 10° elevation according to the principles of the present disclosure.

Referring to FIG. 3B, a plot of gain versus frequency for two embodiments of conformal slot antennas at 10° elevation according to the principles of the present disclosure is shown. More specifically, the dashed line is the predicted performance from the model and the solid line is the measured data. There was a known discrepancy in the calibration from 20-26.5 GHz hence the 3 dB difference in the data over that range is not seen in the higher frequency data. P50 refers to the 50 percentile gain over azimuth at the particular elevation. Therefore 50% of the gain points are above and below that line. P20 refers to the 20 percentile gain over azimuth at the particular elevation. Therefore 20% of the gain points are above and 80% below that line. If there is a large difference between P50 and P20 then it is a sign there is nulling occurring in the antenna pattern.

Figure 3C:
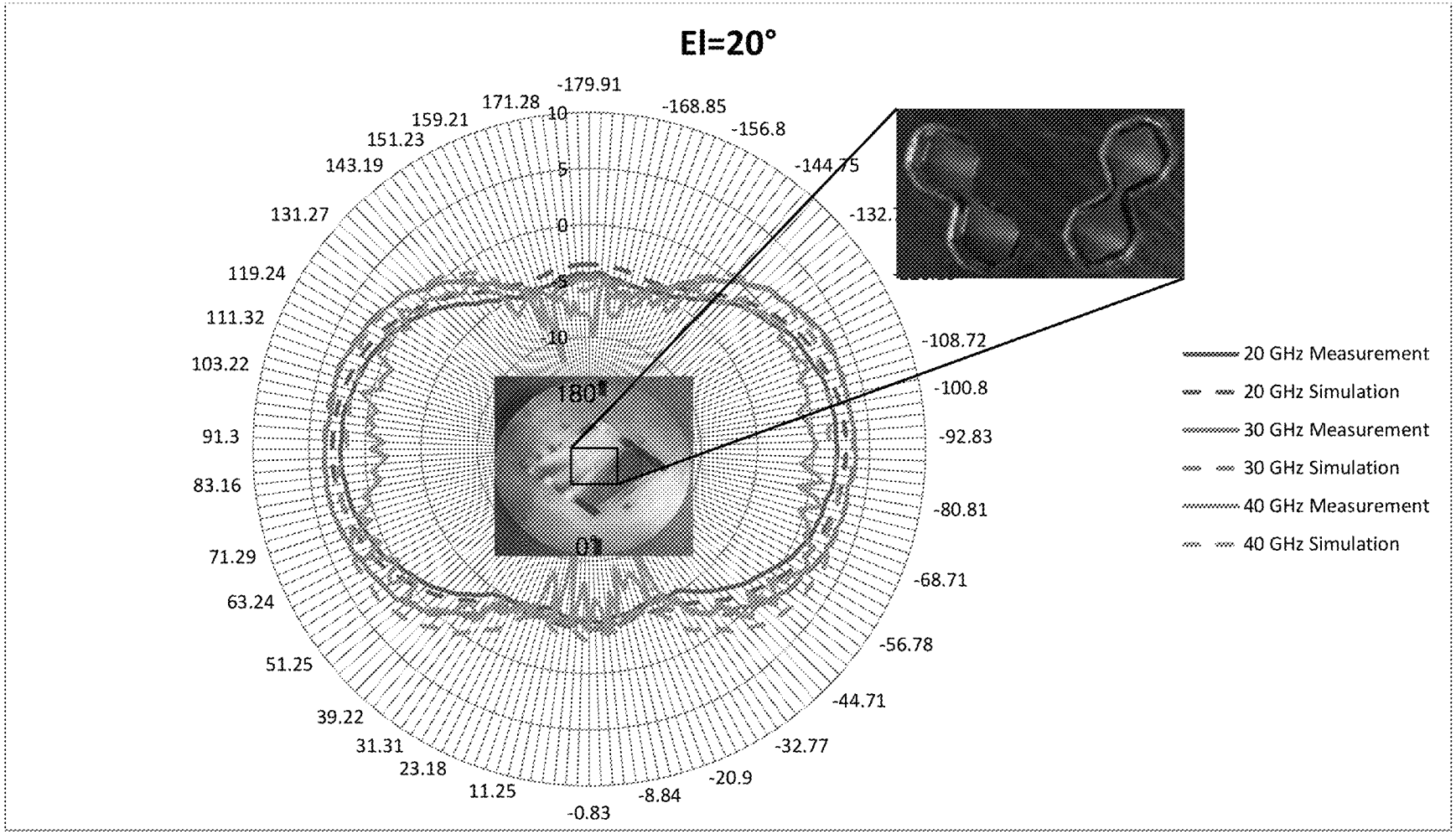
FIG. 3C is a plot of azimuth modeled versus measured singular polarization at 20° elevation for one embodiment of a conformal slot antenna according to the principles of the present disclosure.

Referring to FIG. 3C, a plot of azimuth modeled versus measured singular polarization at 20° elevation for one embodiment of a conformal slot antenna according to the principles of the present disclosure is shown. More specifically, 20 GHz, 30 GHz, and 40 GHz are plotted. These give representative antenna patterns over the whole frequency range. It can been seen that the measured data correlated well with the model data. At 40 GHz the delta between the model and measured data is most likely diffraction effects related to the ground plane.

Figure 3D:
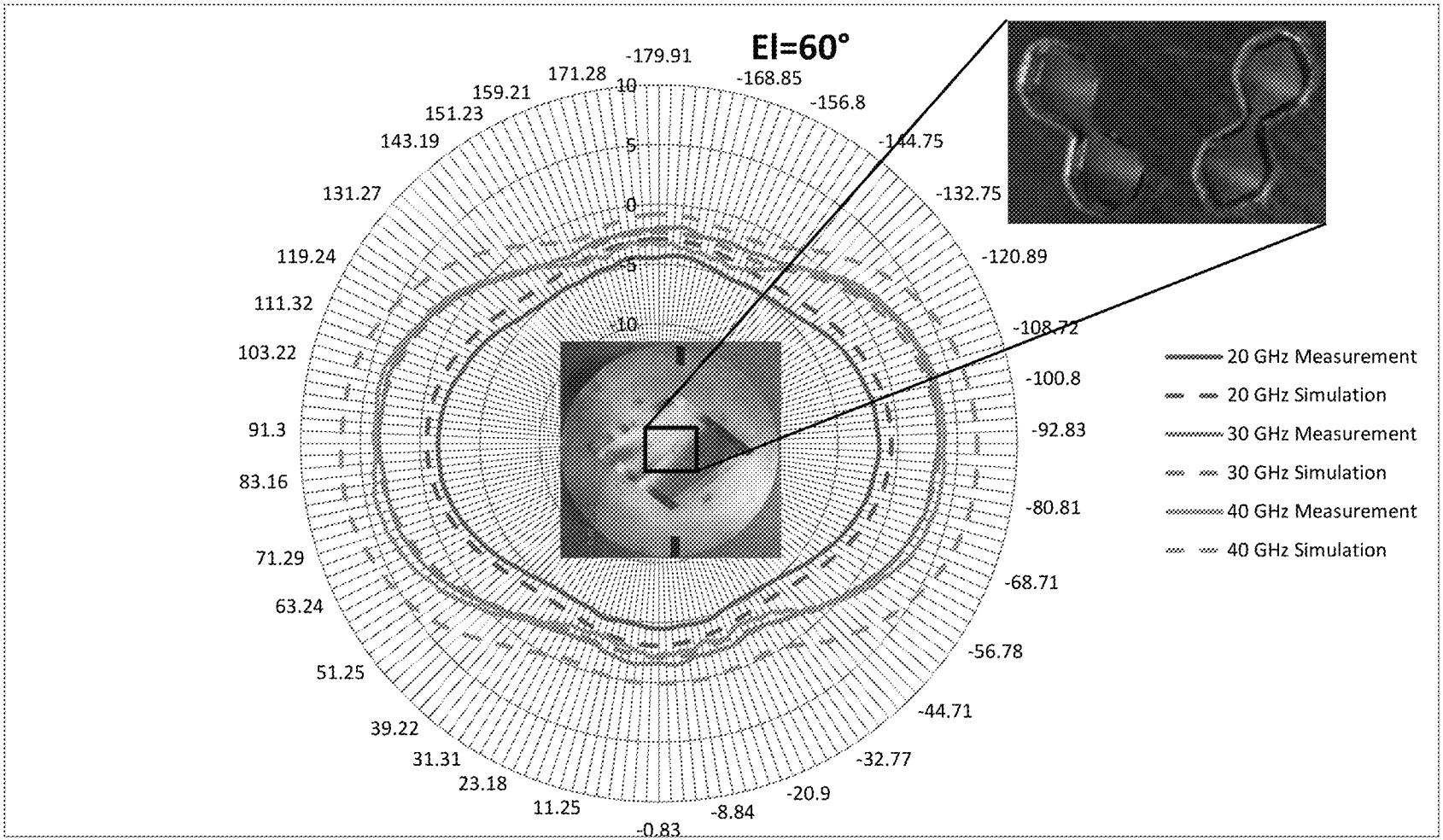
FIG. 3D is a plot of azimuth modeled versus measured singular polarization at 60° elevation for one embodiment of a conformal slot antenna according to the principles of the present disclosure.

Referring to FIG. 3D, a plot of azimuth modeled versus measured singular polarization at 60° elevation for one embodiment of a conformal slot antenna according to the principles of the present disclosure is shown. More specifically, 20 GHz, 30 GHz, and 40 GHz are plotted. These give representative antenna patterns over the whole frequency range. It can been seen that the measured data correlated well with the model data. At 40 GHz the delta between the model and measured data is most likely diffraction effects related to the ground plane.

Figure 3E:
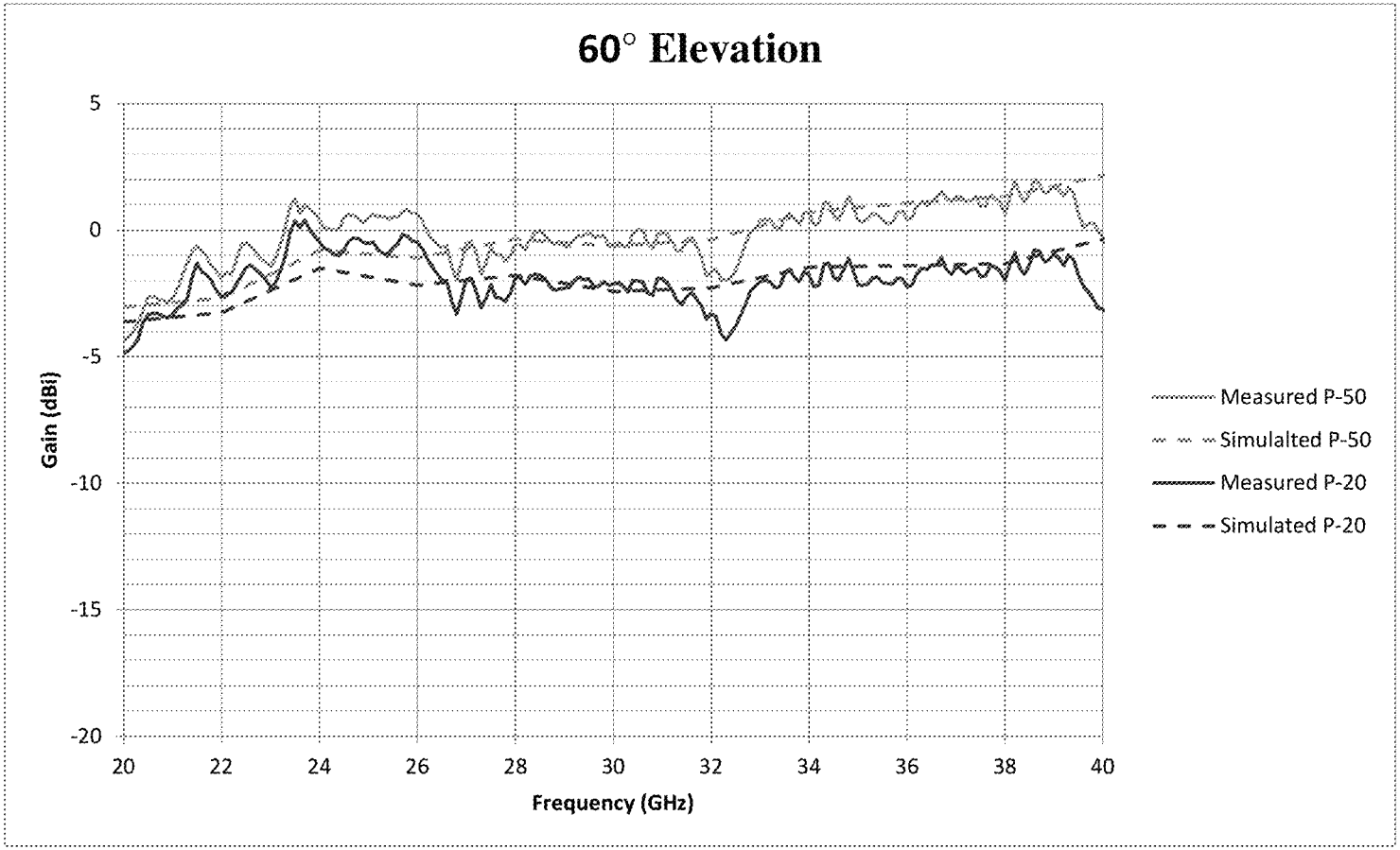
FIG. 3E is a plot of gain versus frequency for two embodiments of conformal slot antennas 60° elevation according to the principles of the present disclosure.

Referring to FIG. 3E, a plot of gain versus frequency for two embodiments of conformal slot antennas at 60° elevation according to the principles of the present disclosure is shown. More specifically, the dashed line is the predicted performance from the model and the solid line is the measured data. There was a known discrepancy in the calibration from 20-26.5 GHz hence the 3 dB difference in the data over that range not seen in the higher frequency data.

Figure 4A:
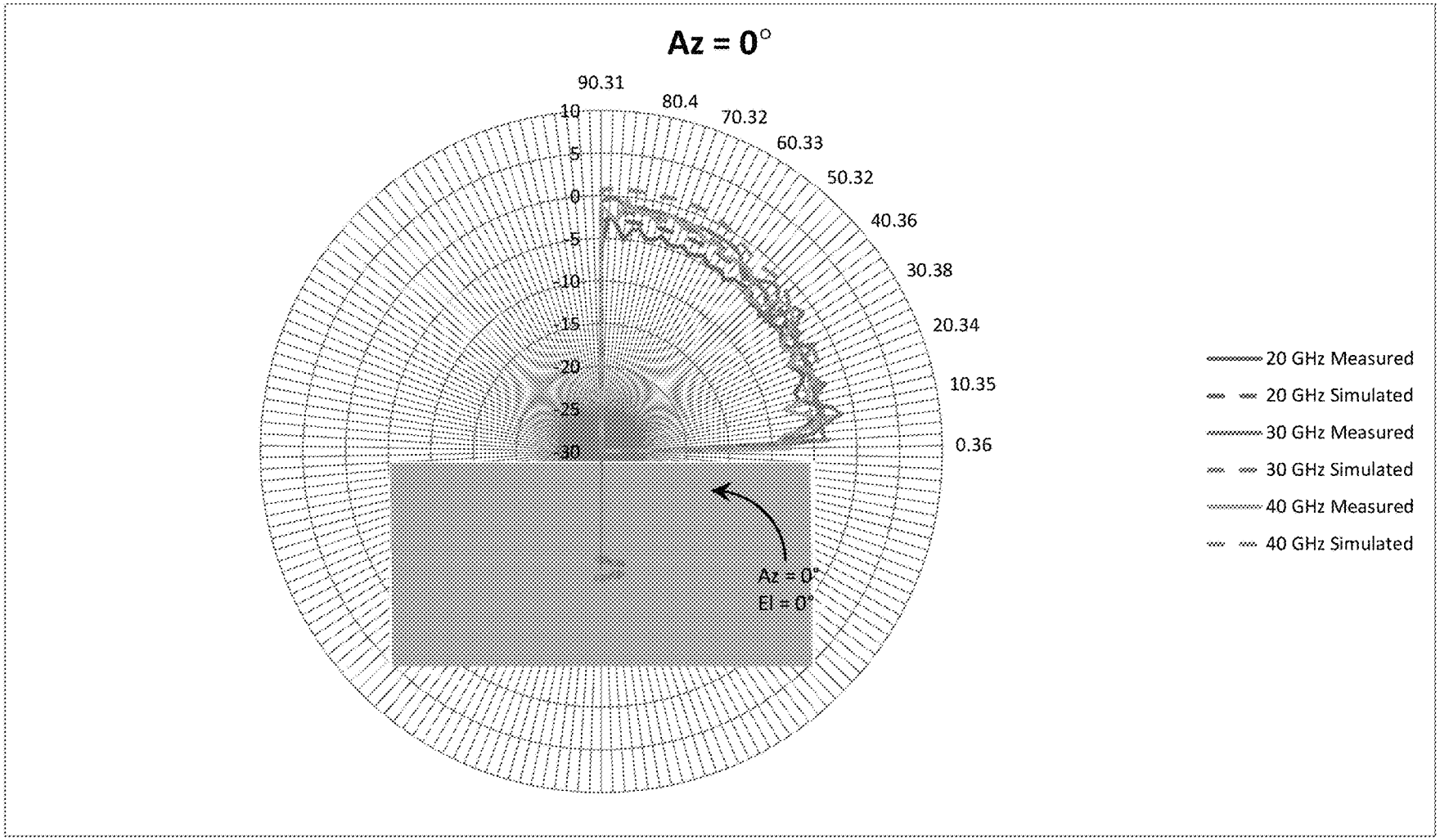
FIG. 4A is a plot of elevation modeled versus measured singular polarization at 0° azimuth for one embodiment of a conformal slot antenna according to the principles of the present disclosure.

Referring to FIG. 4A, a plot of elevation modeled versus measured singular polarization at 0° azimuth for one embodiment of a conformal slot antenna according to the principles of the present disclosure is shown. More specifically, 20 GHz, 30 GHz, and 40 GHz are plotted. These give representative antenna patterns over the whole frequency range. It can been seen that the measured data correlated well with the model data. The ripple in the antenna patterns over elevation is related to the diffraction effects of the ground plane used.

Figure 4B:
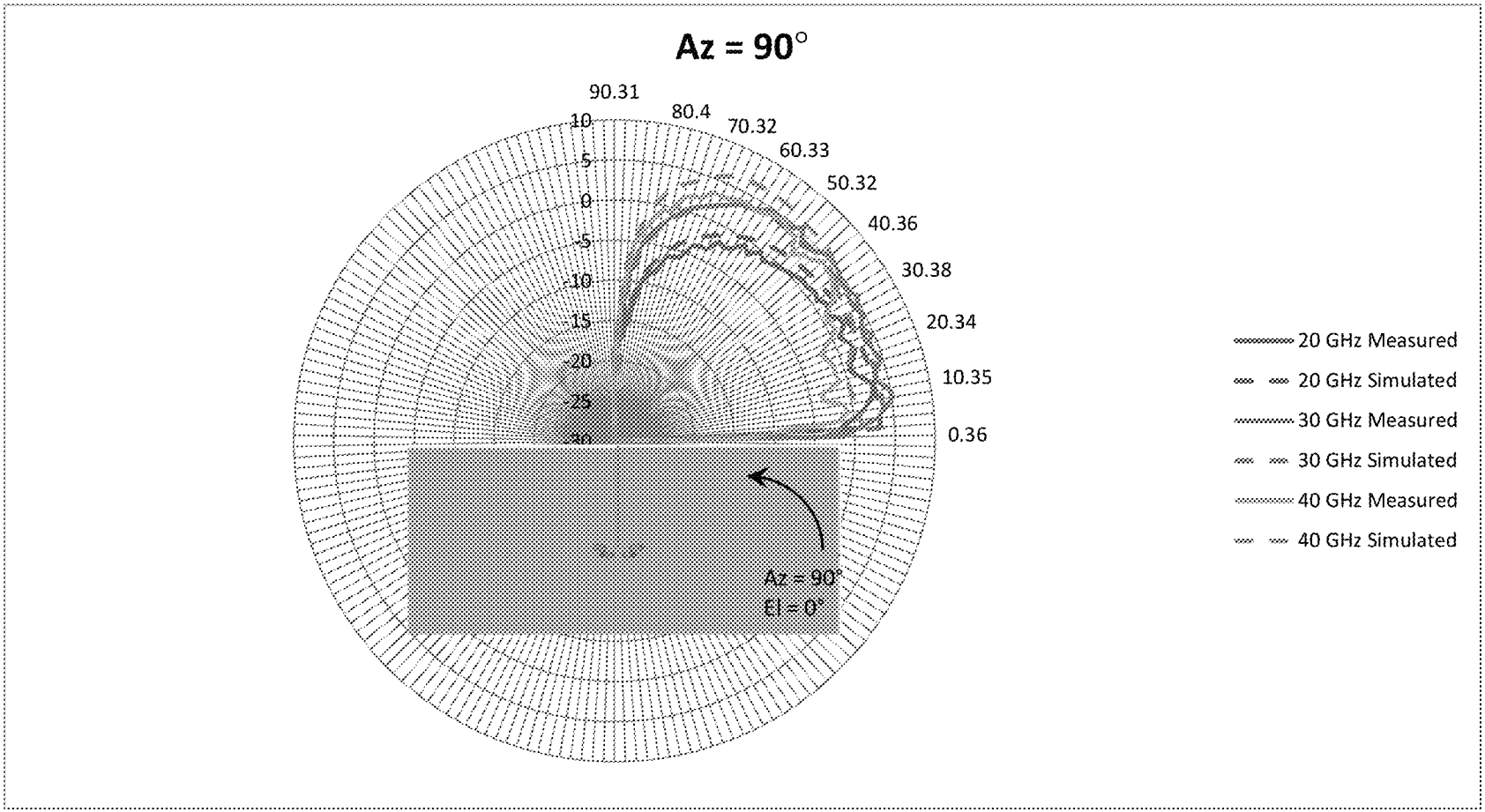
FIG. 4B is a plot of elevation modeled versus measured singular polarization at 90° azimuth for one embodiment of a conformal slot antenna according to the principles of the present disclosure.

Referring to FIG. 4B, a plot of elevation modeled versus measured singular polarization at 90° azimuth for one embodiment of a conformal slot antenna according to the principles of the present disclosure is shown. More specifically, 20 GHz, 30 GHz, and 40 GHz are plotted. These give representative antenna patterns over the whole frequency range. It can been seen that the measured data correlated well with the model data. The ripple in the antenna patterns over elevation is related to the diffraction effects of the ground plane used.

One embodiment of the antenna of the present disclosure is a dual slot antenna with a microstrip feed. In some cases, the feed lines can be microstrip or stripline. In one embodiment, a conformal cavity backed slot antenna has a 50 ohm feed that splits into two 100 ohms and operates at mmW frequencies. The slot antenna can be a PCB or can have additional aluminum layer with the slots cut out of it. It may or may not have a radome. In some cases, there can be a connector or direct attach to electronics. The barbell shape of the slots is one geometry, but other geometries are possible.

Stripline and microstrip are methods of routing high speed transmission lines on a PCB. Stripline is a transmission line trace surrounded by dielectric material and suspended between two ground planes on internal layers of a PCB. Microstrip routing is a transmission line trace routed on an external layer of the PCB. Because of this, the microstrip is separated from a single ground plane by a dielectric material. Having the transmission line on the surface layer of the board provides better signal characteristics compared to stripline. Board fabrication is also less expensive since the layer structure of one plane and one signal layer makes the manufacturing process simpler.

In many cases, stripline can be more complex to manufacture because it requires multiple layers and an embedded trace between two ground planes. However, the width of a controlled impedance trace in stripline is less than an impedance trace in microstrip of the same value due to the second ground plane. In certain cases, smaller trace widths enable greater densities, which in turn enable a more compact design. The internal layer routing of a stripline also reduces EMI and provides better hazard protection.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A conformal slot antenna, comprising: a conformal cavity backed millimeter wave (mmW) slot antenna with approximately positive gain and hemispherical gain coverage operating at 20-40 GHz, having a 50-ohm feed that splits to two 100-ohm feeds of same lengths to feed a pair of slots with same geometries operating at wavelengths between one and ten millimeters, wherein each of the slots with same geometries tapers down at a feed point.

2. The conformal slot antenna according to claim 1, wherein the geometries of each of the slots with same geometries resembles a barbell, wherein each half of the barbell is an irregular octagon, and the feed point is located between the irregular octagons.

3. The conformal slot antenna according to claim 1, wherein the conformal slot antenna is a printed circuit board.

4. The conformal slot antenna according to claim 1, wherein the conformal slot antenna comprises aluminum.

5. The conformal slot antenna according to claim 1, further comprising a radome.

6. The conformal slot antenna according to claim 1, further comprising microstrip feedlines.

7. The conformal slot antenna according to claim 1, further comprising stripline feedlines.

8. The conformal slot antenna according to claim 1, further comprising a connector coupled to electronics.

9. A conformal slot antenna, comprising: a conformal cavity backed millimeter wave (mmW) slot antenna with approximately positive gain and hemispherical gain coverage operating at 20-40 GHz, the conformal slot antenna having a pair of slots each having a geometry resembling a barbell, wherein each half of the barbell is an irregular octagon, and a feed point is located between the irregular octagons, a 50-ohm feed that splits to two 100-ohm feeds to feed each of the pair of slots operating at wavelengths between one and ten millimeters, and wherein each of the pair of slots having a geometry resembling a barbell tapers down at the feed point.

10. A conformal slot antenna, comprising: a conformal cavity backed millimeter wave (mmW) slot antenna with approximately positive gain and hemispherical gain coverage operating at 20-40 GHz; a microstrip launch and feed; and a surface mounted connector; the conformal slot antenna having a 50-ohm feed that splits to two 100-ohm feeds to feed each of a pair of slots operating at wavelengths between one and ten millimeters, wherein each of the pair of slots tapers down at a feed point and resembles a barbell, wherein each half of the barbell is an irregular octagon, and the feed point is located between the irregular octagons.

* * * * *